United States Patent [19]

Marchadour

[11] 3,948,421

[45] Apr. 6, 1976

[54] FEED MECHANISM FOR FEEDING A PRODUCT TO A GAUGING DEVICE OF A GAUGING AND CANNING MACHINE

[76] Inventor: Jean C. Marchadour, Route de Keradennec, Quimper (Finistere Sud), France

[22] Filed: Nov. 17, 1971

[21] Appl. No.: 200,262

[30] Foreign Application Priority Data

Nov. 20, 1970 France ..... 70.41804

[52] U.S. Cl. ..... 222/240; 222/108; 222/189; 222/241

[51] Int. Cl.[2] ..... B65G 65/46

[58] Field of Search ..... 222/240, 241, 342, 108, 222/189, 564, 404; 100/117, 126; 259/105

[56] References Cited

UNITED STATES PATENTS

| | | | |
|---|---|---|---|
| 400,807 | 4/1889 | Toepfer | 222/241 X |
| 1,369,968 | 3/1921 | Draver | 222/273 |
| 1,859,290 | 5/1932 | Davis | 222/241 X |
| 2,279,640 | 4/1942 | Ringmarck | 222/342 X |
| 3,305,133 | 2/1967 | Parker | 222/241 X |
| 3,580,419 | 5/1971 | Carter | 222/189 X |

*Primary Examiner*—Stanley H. Tollberg
*Assistant Examiner*—John P. Shannon
*Attorney, Agent, or Firm*—DeLio and Montgomery

[57] ABSTRACT

A feed mechanism for feeding a food product to a volumetric gauging device of a gauging and canning machine comprises a feed hopper having a first feed screw adjacent the hopper outlet and a second feed screw located above the first feed screws and arranged to scrape the walls of the hopper. The two feed screws are rotated in opposite senses.

5 Claims, 4 Drawing Figures

Inventor
Jean C. Marchadour
By Pelio and Montgomery
Attorneys

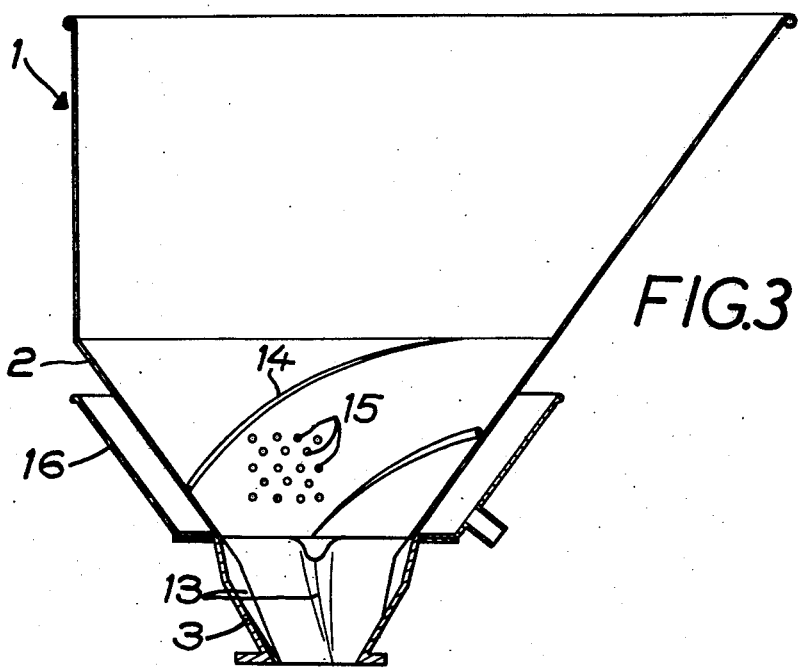
FIG.3
FIG.4
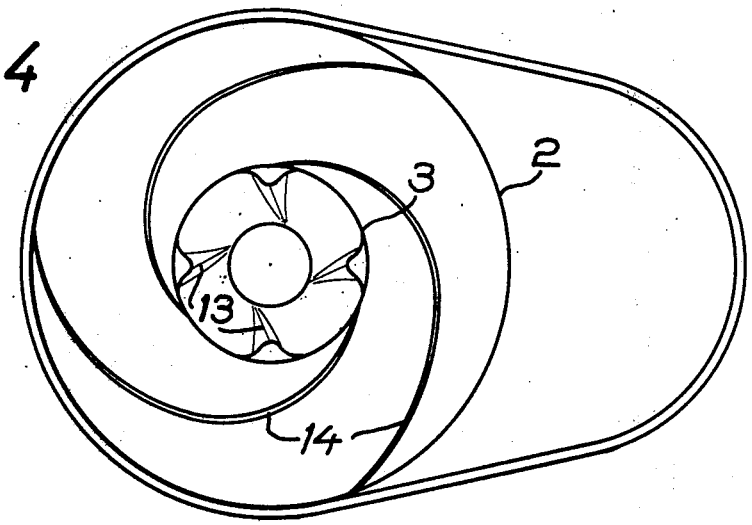
Inventor
Jean C. Marchadour
By De Lio and Montgomery
Attorneys

FEED MECHANISM FOR FEEDING A PRODUCT TO A GAUGING DEVICE OF A GAUGING AND CANNING MACHINE

FIELD OF THE INVENTION

The invention relates to a feed mechanism for feeding a product to a gauging device of a gauging and canning machine.

SUMMARY OF THE INVENTION

According to the present invention, there is provided in a feed mechanism for feeding a product to a gauging device of a gauging and canning machine, a hopper, said hopper comprising wall means, and means defining a discharge outlet, said wall means converging towards the discharge outlet, a first feed screw adjacent the discharge outlet, a second feed screw co-axial with said first feed screw and located above the first feed screw, said second feed screw including blade means in scraping relationship with the interior of said wall means, and drive means rotating said first and second feed screws in opposite senses.

BRIEF DESCRIPTION OF THE DRAWINGS

An embodiment of the invention will now be described, by way of example only, with reference to the accompanying diagrammatic drawing, in which:

FIG. 3 is a longitudinal section, to an enlarged scale, of a hopper of the mechanism shown in FIG. 1; and FIG. 4 is a plan of the hopper shown in FIG. 3.

DESCRIPTION OF THE PREFERRED EMBODIMENT

Figure 1:
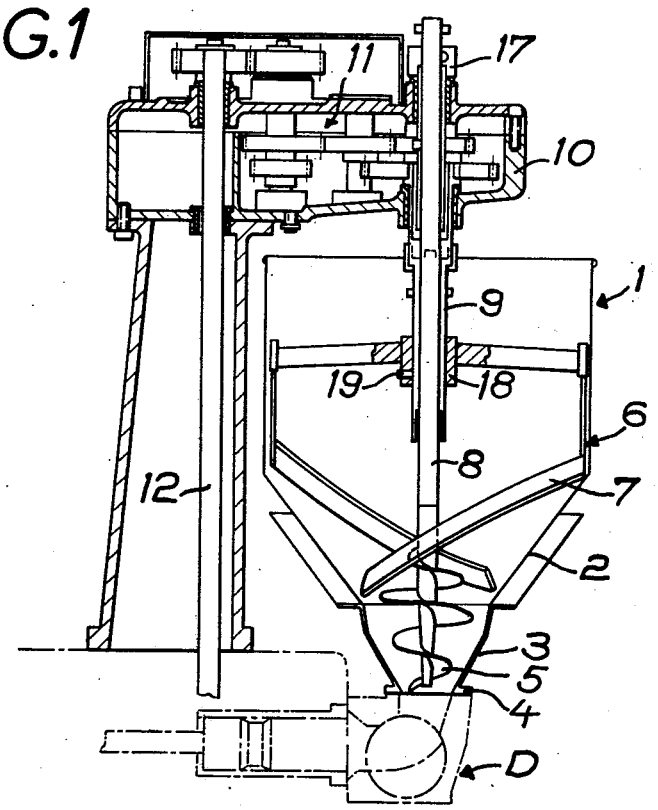
FIG. 1 is a longitudinal section of a feed mechanism according to the invention.
Figure 2:
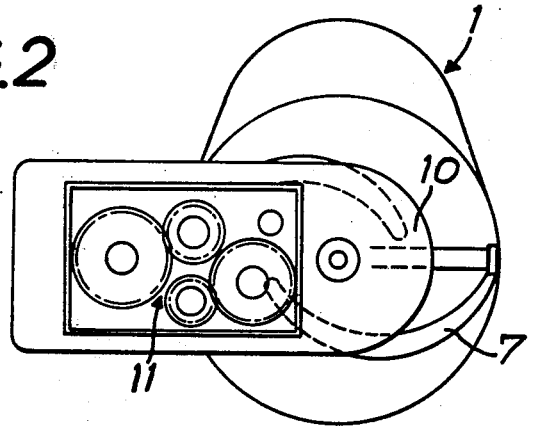
FIG. 2 is a plan of the mechanism shown in FIG. 1.

The feed mechanism, as illustrated, comprises a hopper 1 comprising two generally frusto-conical portions 2 and 3. The discharge outlet of the hopper is bounded by a flange 4 by which the hopper 1 is fixed to a gauging mechanism D of a gauging and canning machine.

Two coaxial feed screws 5 and 6 are mounted within the hopper 1. The screw 5 is an Archimedian screw and lies generally within the portion 3 of the hopper 1 and is operative to thrust a food product within the hopper 1 towards the gauging mechanism D, and the screw 6 is situated within the portion 2 of the hopper 1 and comprises helical blades 7 which to some extent scrape the walls of the hopper 1.

The two screws are fixed to respective concentric telescopic spindles, 8 and 9, which rotate in opposite senses. The spindles 8 and 9 are suspended from a housing 10 enclosing gears 11 which transmit drive to the spindles 8 and 9 from a drive shaft 12. The spindles 8 and 9 are driven only during the portion of the operational cycle of the machine in which product is to be fed to the gauging mechanism D.

To prevent the product from being carried as a body around the hopper 1 by the screws and to guide its descent within the hopper 1, the inner surface of the portion 3 carries ribs 13, which lie substantially along the generator line of the frusto-conical portion 3, but are slightly inclined in the sense of rotation of the screw. The inner surface of the portion 2 carries spiral fins 14, and for certain products it contains holes 15, through which liquid can drain from the product, the liquid being collected in a container 16 which surrounds the portion 2.

The spindle 8 and hence also the screw 5 can be adjusted vertically by means of a locking collar 17 at the upper end portion of the spindle 8, while the screw 6 can be adjusted vertically on the spindle 9, which is hollow, by moving a hub 18 of the screw 6 along the spindle 9 and locking the hub 18 to the spindle 9 in a selected position by a screw 19.

What is claimed is:

1. A feed mechanism for feeding a product to a gauging device comprising a hopper having wall means and a discharge outlet, said wall means converging towards the discharge outlet, a first feed screw adjacent the discharge outlet and arranged to feed product through the discharge outlet, a second feed screw co-axial with said first feed screw and located above the first feed screw so as to direct product downwardly, said wall means comprising a first frusto-conical wall portion surrounding said first feed screw and having its inner surface provided with rib means lying substantially along the generator line of said first wall portion, and a second frusto-conical wall portion surrounding said second feed screw and having its inner surface provided with spiral fin means, said second feed screw including blade means in scraping relationship with the interior of said second wall means, and drive means rotating said first and second feed screws in opposite directions.

2. A mechanism according to claim 1 further comprising container means surrounding said second frusto-conical wall portion, said second frusto-conical wall portion being perforated to permit liquid to drain from product within said second frusto-conical wall portion into said container means.

3. A mechanism according to claim 1 wherein said drive means comprises first and second concentric spindles respectively driving said first and second feed screws, and gear box means enabling the speed of said first and second spindles to be independently regulated, said first and second spindles being dependent from said gear box means.

4. A mechanism according to claim 3 wherein said gear box means is adapted to drive said spindles only when product is to be fed into a gauging device.

5. A mechanism according to claim 1 wherein the drive means includes a hollow spindle, a hub fixed to said spindle and arms projecting radially from said hub, the second feed screw members being mounted on the ends of said arms.

* * * * *